United States Patent [19]

Oakley

[11] Patent Number: 4,506,584

[45] Date of Patent: Mar. 26, 1985

[54] METHOD OF MANUFACTURE OF WARP-RESISTANT NECKS FOR STRINGED INSTRUMENTS

[76] Inventor: Tony D. Oakley, Rte. 1, Box 109, Timberlake, N.C. 27583

[21] Appl. No.: 494,714

[22] Filed: May 16, 1983

[51] Int. Cl.[3] ..... G10D 3/00

[52] U.S. Cl. ..... 84/293

[58] Field of Search ..... 84/267, 293

[56] References Cited

U.S. PATENT DOCUMENTS 3,901,119 8/1975 Siminoff ..... 84/293

4,313,362 2/1982 Lieber ..... 84/267

FOREIGN PATENT DOCUMENTS 2013941 10/1971 Fed. Rep. of Germany ..... 84/293

*Primary Examiner*—Lawrence R. Franklin

*Attorney, Agent, or Firm*—William C. Lawton

[57] ABSTRACT

Described herein is a method, and its associated article, for forming a neck for a stringed musical instrument having a hollow, slotted torsion rod disposed therein to function as a straightening force or to counteract the tension and bowing or warping effect of the instrument strings. The method comprises providing a longitudinally extending opening along the length of the neck of the instrument complimentarily formed to receive a slotted torsion rod, the slots being disposed to the bottom or back of the instrument neck. An end of the rod, preferably the end not connected to the instrument body, is provided with a tightening means for the rod to counter the warping or bowing forces on the instrument neck by the tightening of the strings.

8 Claims, 3 Drawing Figures

METHOD OF MANUFACTURE OF WARP-RESISTANT NECKS FOR STRINGED INSTRUMENTS

BACKGROUND OF THE INVENTION

There have been efforts in the past to construct the necks of stringed musical instruments, primarily guitars, in such a way as to prevent the warping and bowing of the necks of these instruments, which is caused by the tension placed upon the necks by the tightening of the strings of the instruments. Although the problem exists to some degree in almost any stringed instrument, the problem is acute in the manufacture of electric guitars where the effect of string tension is severest. Efforts have been made in the past to develop methods for preventing such bending of the instrument necks. However, none of the past methods involve the simplicity of construction and the apparent success of the present invention in maintaining the necks of such instruments in as straight a position as this invention.

The use of adjustable torsion rods in stringed instrument necks is dictated by the need to counteract the force exerted by the strings upon the body and neck of the instrument. To the maximum extent possible, the torsion rod should also be able to restrict the degree of warpage associated with wooden necks due to change in moisture content and temperature. Maintaining proper neck geometry is necessary to insure maximum "playability", tuning and sound, especially near the body of the instrument where the effects of the misalignment of the instrument neck are most profound.

Virtually all stringed instruments use stretched strings tuned by varying tension which, when played, involve the shortening of the strings by pressing the string against the neck of the instrument at particular points. On most guitars and guitar-like instruments, the neck has an array of wires embedded in the neck to vary the effective length of the strings and consequently the sound generated by the string when it is played. These "frets" are normally arranged according to a mathematical pattern so that the strings generate particularly desired frequencies during playing of the instrument.

When string tension, string height, fret alignment and bridge position are all in proper relationship, the instrument is said to possess proper intonation. This intonation is lost when any of the relationships are altered by warpage of any of these components. If a wooden instrument neck warps, it changes the tension on the strings causing improperly tuned notes to be generated. In addition, once initial warpage occurs, the string tension, altered to compensate for the warpage, simply increases the tension which caused the initial warpage and thus generally accelerates the process.

Because string tension generally provides an upward tension component from the neck of the instrument, there is little likelihood of a convex warpage of the neck downward or towards the back of the instrument. The primary sources of warpage or bowing are a concave warping of the neck or a bowing, either to the left or the right.

Torsion rods are used to prevent the neck of the instrument from warping or assuming a concave shape. There are three primary designs currently in use to prevent this type of warping. The most common type consists of one or more threaded steel rods placed inside the neck of the instrument. One end of the rod is anchored in the neck and an adjusting nut is placed upon the other end of the rod so that as the nut is tightened, the tuner end of the neck is pulled down. Since the depth of the neck of a musical instrument from top to bottom is limited, the practical limit of this design is diminished because the angle at which this steel rod can be placed from one end of the neck to the other is very limited. Furthermore, this design has a very serious drawback in that in order to create the amount of force necessary to cause a downward motion of the neck of the instrument, the compression force placed upon the neck of the instrument is approximately ten times the force created to cause the downward motion. This severe compression of the neck may cause the neck to develop a series of buckles, especially near the body of the instrument. This rippling effect may actually create a worse problem in terms of playability and tone than the original warpage problem, thus, with this design, the cure may be worse than the disease. This compression may also cause the neck to curve in the lateral plane either to the right or left. This is a common problem since most stringed instruments use thicker strings on one side of the neck than on the other, causing unequal stress. The compression force of this existing design aggravates the tendency of the neck to curve to one side.

Furthermore, this particular design also tends to cause a spiraling or twisting of the neck. This result is possible whenever the grain of the wood used to construct the neck fails to be perfectly straight and symmetrical throughout the length of the neck. In this condition, the neck tends to twist along its axis causing different string clearance along the neck of the instrument. This also affects the playability of the instrument. The tension or compression caused by this particular design aggravates the spiraling problem.

The second existing design consists of a threaded rod placed in the body of the neck of the musical instrument anchored at one end with an adjusting nut on the other end. In this design, the neck must be internally grooved to accept the concave shape of the torsion rod. As the nut is tightened, the rod tends to straighten and cause the neck to straighten. Since the rod is already curved in relation to the neck, if the neck of the instrument happens to warp in the direction of the curve, this design accentuates the warpage as the nut is tightened. Similarly with the first device of the prior art, the compression caused by the tightening of this device creates the same difficulties associated with the first design, and in some cases to a greater extent.

The third common type of adjustable tension rod incorporates two parallel rods fastened together at one end thereof and placed within the neck of the instrument. At the other end of the torsion rods, the upper rod abuts against an enlarged, dished washer. The lower rod extends through the center of the dished washer and is threaded at the end. As the adjusting nut is tightened, the lower rod becomes shorter, causing the entire device to assume an arc. This design overcomes some of the compression problems of the other designs allowing only the force of the arc to be transferred to the neck of the instrument. However, with this design, the forces that cause torsional spiraling and lateral curvature to the right or left of the neck of the instrument remain unchecked. This third design is much more expensive and difficult to install, thusly increasing the price of the instrument.

Another design disclosed in U.S. Pat. No. 4,237,944 discloses a design of the latter type. This structure and design requires a complete redesign and manufacture of the neck of the stringed instrument, which is foreign to the manufacture of many stringed instruments and is not adapted or adaptable to the common manufacturing techniques of many of the stringed instruments to which the present invention is easily adaptable.

OBJECTS OF THE INVENTION

In order to overcome all of the disadvantages of the prior art and to provide a torsion bar easily adapted to the manufacturing techniques presently in existence for many, if not most, of the stringed musical instruments in existence, the following technique has the advantage that it can be performed much more economically than the existing methods of manufacture, and provides a finished musical instrument which is visually pleasing, which overcomes all of the warping or bowing forces existing in most stringed musical instruments, and thusly provides a device which will maintain its tune and playability better than the instruments of the prior art.

Accordingly, it is an object of this invention to provide a method of constructing a guitar neck which requires less time and money than prior art methods.

It is another object of the invention to provide a method for forming a stringed musical instrument neck overcoming all of the warping or bowing forces associated with stringed musical instruments at a decreased manufacturing cost.

A further object of this invention contemplates the providing of a musical instrument neck of pleasing finished appearance, ease of installation and simplicity of construction vastly superior to those of the prior art.

Other objects and advantages of the present invention will become apparent in the following specification and claims when considered in light of the attached drawings.

DESCRIPTION OF THE INVENTION

Figure 1:
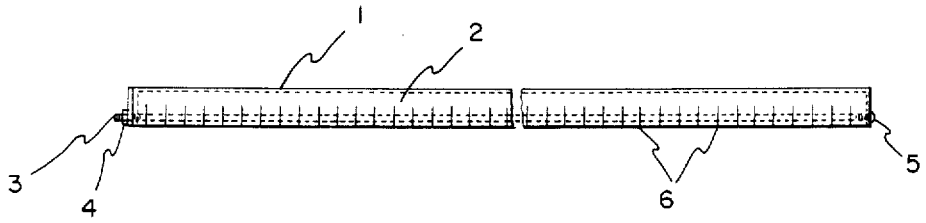
FIG. 1 shows the general structure of the torsion rod of the present invention as viewed from the side thereof.

The following is a description of the present invention in general terms as well as in its preferred embodiment. The drawings referred to are intended to be illustrative only of the invention and are not intended in any way to limit the scope of the invention as generally described herein. Similarly, the preferred embodiment of the invention may be described in more specific detail. This also is intended to be illustrative of the invention and not intended in any way to limit the scope thereof.

Referring to the drawings, wherein like reference numerals refer to like parts throughout, reference numeral 1 generally denotes the torsion bar of the present invention. The torsion bar is a length of strong material resistant to twist or warp having a hollow central portion therein. There are a number of slits, numeral 6, provided along the length of the underside thereof, these slits preferably extending more than one-half the distance between the top and the bottom of the rod, numeral 1. A substantially straight bar is connected to or held in place at one end of the rod, as indicated by numeral 5. That bar generally extends the length of the rod and protrudes through the other end thereof as shown. The protruding end of the rod is threaded, as shown at numeral 3, and has a nut, numeral 4, provided thereon. This bar, numeral 2, is generally disposed below the midway point between the top and the bottom of the torsion rod, numeral 1. When the nut is tightened, the torsion rod, numeral 1, tends to bow upwards as the spaces in the slits, numeral 6, are contracted by the tightening of the nut, numeral 4. The cross-sectional shape of the torsion rod, numeral 1, can be round, octagonal, hexagonal, triangular, rectangular, or square. If triangular, the base of the triangle would preferably be the upper surface of the torsion rod, as this structure would be most effective in reducing the side to side bowing of the neck of the stringed instrument as discussed below. The most preferable cross-sectional shape of the rod would be square or circular or rectangular, primarily because these shapes would be the easiest to manufacture or acquire. The width of the slits is generally not critical, the width of the slits being somewhat dictated by the number of slits provided along the length of the torsion rod. Obviously, the more finely tuned the stringed instrument in which the present invention is incorporated is used, the more desirable would be the inclusion of a large numer of narrower slits along the length thereof so that when the nut, numeral 4, on the bar, numeral 2, is tightened, the upward bowing of the torsion rod, numeral 1, would more generally approximate a circular curve.

When incorporated in the neck of a stringed instrument according to this invention, the portion of the torsion rod which is not provided with slits, for example, the upper portion of the torsion rod, controls the tendency of the neck of the instrument to bow from side to side. The threaded bar provided in the torsion rod provides the straightening effect to compensate for warping caused by string tension when the nut, numeral 4, on the bar, numeral 2, is tightened. The slits, numeral 6, provided on the lower portion of the torsion rod control the direction of warp correction. The slits are usually on the lower side of the torsion bar as it is placed in the neck of the musical instrument and would, therefore, correct an upward warping of the neck of the instrument caused by string tension.

The material from which the torsion rod of the present invention is constructed is restricted only by the stress to which it will be placed when incorporated into the neck of a musical instrument. The material need only be sufficiently rigid to withstand the upward stress on the neck caused by string pressure and be similarly strong enough to resist compression and warp in the wooden neck due to the expansion and contraction stress normally inherent in wooden instrument necks. Metal is a preferable material, primarily because metal, and preferably a brass alloy or steel, has better resonance characteristics and would, thus, be less likely to affect the musical characteristics of the instrument in which the torsion rod of the present invention is incorporated.

Figure 2:
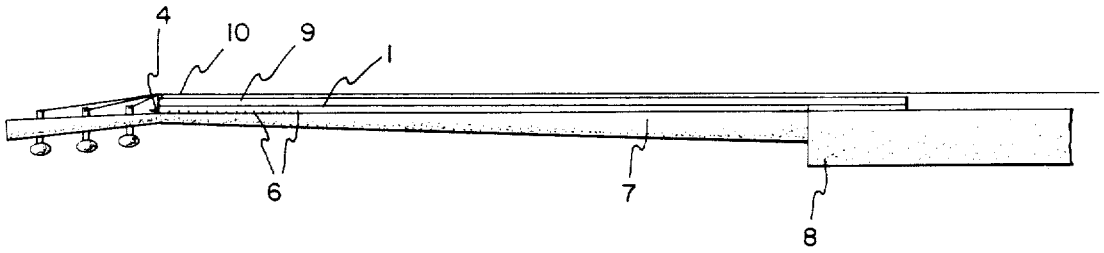
FIG. 2 shows the placement or relationship of the torsion rod of FIG. 1 in place in the neck of a stringed musical instrument such as a guitar, as viewed from the side thereof.
Figure 3:
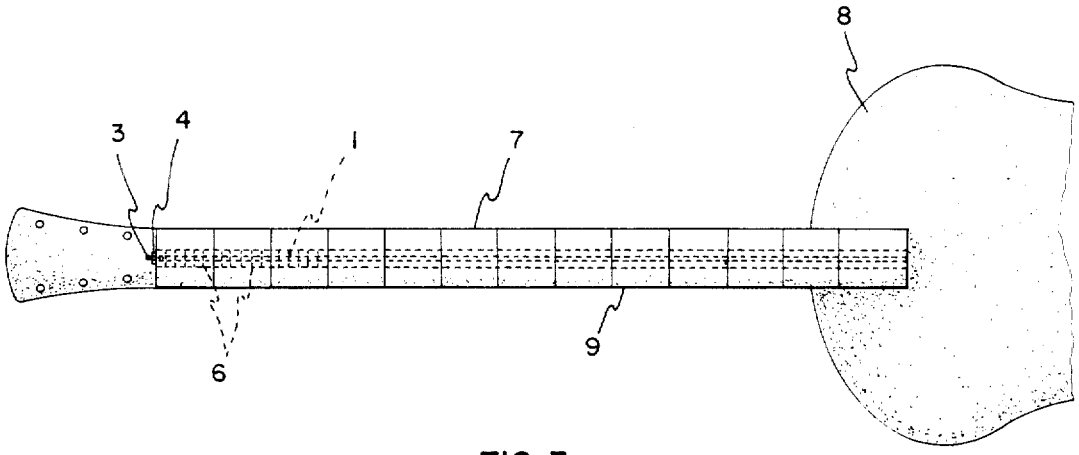
FIG. 3 shows a view of the placement of the torsion rod of the present invention in the neck of a conventional stringed instrument such as a guitar, as viewed from the top thereof. The strings of the instrument are purposely omitted from this view to facilitate easy understanding of the drawing.

FIGS. 2 and 3 depict the positioning of the torsion rod, numeral 1, of the present invention in a stringed musical instrument such as a guitar, numeral 8. As can be seen, the torsion rod, numeral 1, is generally located in the central area of the width of the instrument neck. This is most clearly shown in FIG. 3. FIG. 2 shows the general location of the torsion rod, numeral 1, along the vertical plane of the instrument neck, numeral 7. The rod is generally provided in the center of or preferably just underneath the fretboard, numeral 9, in the neck of the instrument. A longitudinally extending opening along the neck of the musical instrument is provided complementary to the shape of the torsion rod, numeral 1, to be placed therein. The rod is securely affixed on all sides to the neck of the musical instrument in the complimentary longitudinally extending opening to insure its secure placement therein. Obviously, if the torsion rod, numeral 1, is centrally located within the neck and the fretboard of the instrument itself, the upper service of the rod, numeral 1, may be exposed. The torsion rod is placed in the longitudinally extending opening with the slits facing the lower side of the neck, numeral 7, of the instrument. The nut provided on the threaded end of a bar extending the length of the rod is shown in the drawings as protruding from the end of the neck farthest from the body of the instrument. However, the nut, which is the tightening means of the present invention, may protrude from the end of the neck connected to the body of the instrument. Numeral 10 depicts the location of the strings above the fretboard, numeral 9, and the torsion rod, numeral 1.

The present invention, when utilized according to the teachings of the specification herein and the claims which follow, is unique in that it allows a controlled movement of the neck of a stringed musical instrument, while at the same time, it almost completely inhibits twist of the neck of the instrument which has been a problem in the past. The present invention also, by its construction and application, eliminates side-to-side warp or bowing of the neck of a musical instrument. The placement of the slits and the location of the threaded bar allow for complete elimination of any concave bowing of the neck of the instrument by the tightening of the nut on the end of the threaded bar of the torsion rod.

It is to be noted that whereas in prior art devices, either an extremely expensive and complex construction of the neck of the musical instrument is required or where the torsion rods of the prior art do not substantially eliminate all types of warp and/or twist in the neck of a stringed musical instrument, the present invention is adaptable to inclusion in the neck of any stringed musical instrument. It is particularly characterized by ease of manufacture and minimum cost. The device of the present invention has no known equivalent in the prior art and maximizes the proper intonation and structural integrity of the musical instrument.

As stated earlier, the method and article of the present invention illustrated in the drawings and described in the above specification is subject to variation within broad parameters of the invention in terms of materials, shapes, slit placement, etc. without departing from the spirit and scope of the appended claims. Thus, it should be clearly understood that numerous structural modifications and adaptations may be resorted to without departing from the spirit of the present invention.

Having thus described my invention, I claim:

1. A method for assembling the neck of a stringed musical instrument so as to prevent stress distortion thereof comprising:

providing a longitudinally extending opening along the length of the neck of said instrument, said opening being substantially centrally located in the width of the neck of the instrument, fixedly and securely disposing within said opening a longitudinally extending hollow torsion rod of a cross-sectional shape complementarily associated with said opening, wherein said rod has a cross-sectional shape consisting of a flat upper surface located nearest the fretboard and a non-circular underside, wherein said torsion rod has a number of transverse slits provided along the length of the underside thereof, said slits extending from the bottom of said rod more than one-half the vertical depth of said rod, and providing a bar extending through the length of said rod and below the vertical center of said rod, said bar securely held against one end of said rod and having a tightening means provided on the opposite end of said rod.

2. The method of claim 1 wherein said rod is constructed from known structural metals comprising, aluminum, steel, brass alloys, copper, iron, and similar metals.

3. The method of claim 2 wherein said rod is constructed from steel or a brass alloy.

4. The method of claim 2 wherein said rod has a cross-sectional shape from the group consisting essentially of square, rectangular, triangular, or hexagonal.

5. The method of claim 1 wherein said rod is located just beneath the fretboard of the neck of said instrument.

6. The method of claim 5 wherein said rod is of a cross-sectional shape from the group consisting essentially of square and rectangular.

7. The method of claim 6 wherein said rod and said bar are constructed from the group of metals consisting essentially of steel and brass alloys.

8. The method of claim 7 wherein said tightening means is a nut provided over the threaded end of said bar.

* * * * *